US006783183B2

(12) United States Patent
Tseng

(10) Patent No.: US 6,783,183 B2
(45) Date of Patent: Aug. 31, 2004

(54) CHAIR WITH A DETACHABLE FRAME BODY AND A SEAT MADE FROM A FLEXIBLE WEB

(76) Inventor: Chun-Hsien Tseng, No. 3, Ting-Hsi-Hsin, Lu-Mn Tsun, Chu-Chi Hsiang, Chiayi Hsien (TW)

( * ) Notice: Subject to any disclaimer, the term of this patent is extended or adjusted under 35 U.S.C. 154(b) by 0 days.

(21) Appl. No.: 10/351,407

(22) Filed: Jan. 27, 2003

(65) Prior Publication Data

US 2004/0145229 A1 Jul. 29, 2004

(51) Int. Cl.[7] ..... A47C 7/00

(52) U.S. Cl. ..... 297/440.24; 297/440.11; 297/452.13

(58) Field of Search ..... 297/440.24, 440.1, 297/440.11, 440.16, 440.21, 452.2, 452.13

(56) References Cited

U.S. PATENT DOCUMENTS 1,969,313 A * 8/1934 Meeker ..... 297/17
2,564,915 A * 8/1951 Nelson ..... 297/287
3,695,702 A * 10/1972 Ingellis ..... 297/440.24
3,870,365 A * 3/1975 Knutsen ..... 297/320
4,119,286 A * 10/1978 Barril ..... 248/188
4,784,436 A * 11/1988 Sutherland ..... 297/440.24
5,678,890 A * 10/1997 Tenbroeck ..... 297/271.6
6,082,820 A * 7/2000 Jeng ..... 297/326

* cited by examiner

*Primary Examiner*—Peter M. Cuomo
*Assistant Examiner*—Stephen Vu
(74) *Attorney, Agent, or Firm*—Baker Botts L.L.P.

(57) ABSTRACT

A chair includes a frame body having a leg unit, a front seat rod member and a backrest rod member disposed above and connected to the leg unit. A flexible web is formed with a front seat sleeve sleeved on the front seat rod member, and a backrest sleeve sleeved on a base rod portion of the backrest rod member. The web is divided into a seat part extending rearwardly from the front seat sleeve, and a backrest part extending upwardly and angled away from the seat part to connect with the backrest sleeve. The backrest part cooperates with the seat part to define a corner therebetween. A string interconnects the corner of the web and one of the leg unit and the backrest rod member.

3 Claims, 3 Drawing Sheets

CHAIR WITH A DETACHABLE FRAME BODY AND A SEAT MADE FROM A FLEXIBLE WEB

FIELD OF THE INVENTION

The invention relates to a chair, more particularly to a chair with a detachable frame body and a seat made from a flexible web.

SUMMARY OF THE INVENTION

The object of this invention is to provide a detachable chair which includes a detachable frame body, a seat made from a flexible web, and a string for fastening the web to the frame body, and which is simple and light.

Accordingly, the chair of this invention includes a frame body, a flexible web, and a string. The frame body includes a leg unit, a front seat rod member disposed above and connected to the leg unit, and a backrest rod member disposed above and connected to the leg unit and having a base rod portion parallel to and disposed above the front seat rod member. The flexible web is formed with a front seat sleeve sleeved on the front seat rod member, and a backrest sleeve sleeved on the base rod portion of the backrest rod member. The web is divided into a seat part extending rearwardly from the front seat sleeve, and a backrest part extending upwardly and angled away from the seat part to connect with the backrest sleeve. The backrest part cooperates with the seat part to define a corner therebetween. The string interconnects the corner of the flexible web and a selective one of the leg unit and the backrest rod member so as to secure the corner to said one of the leg unit and the backrest rod member.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
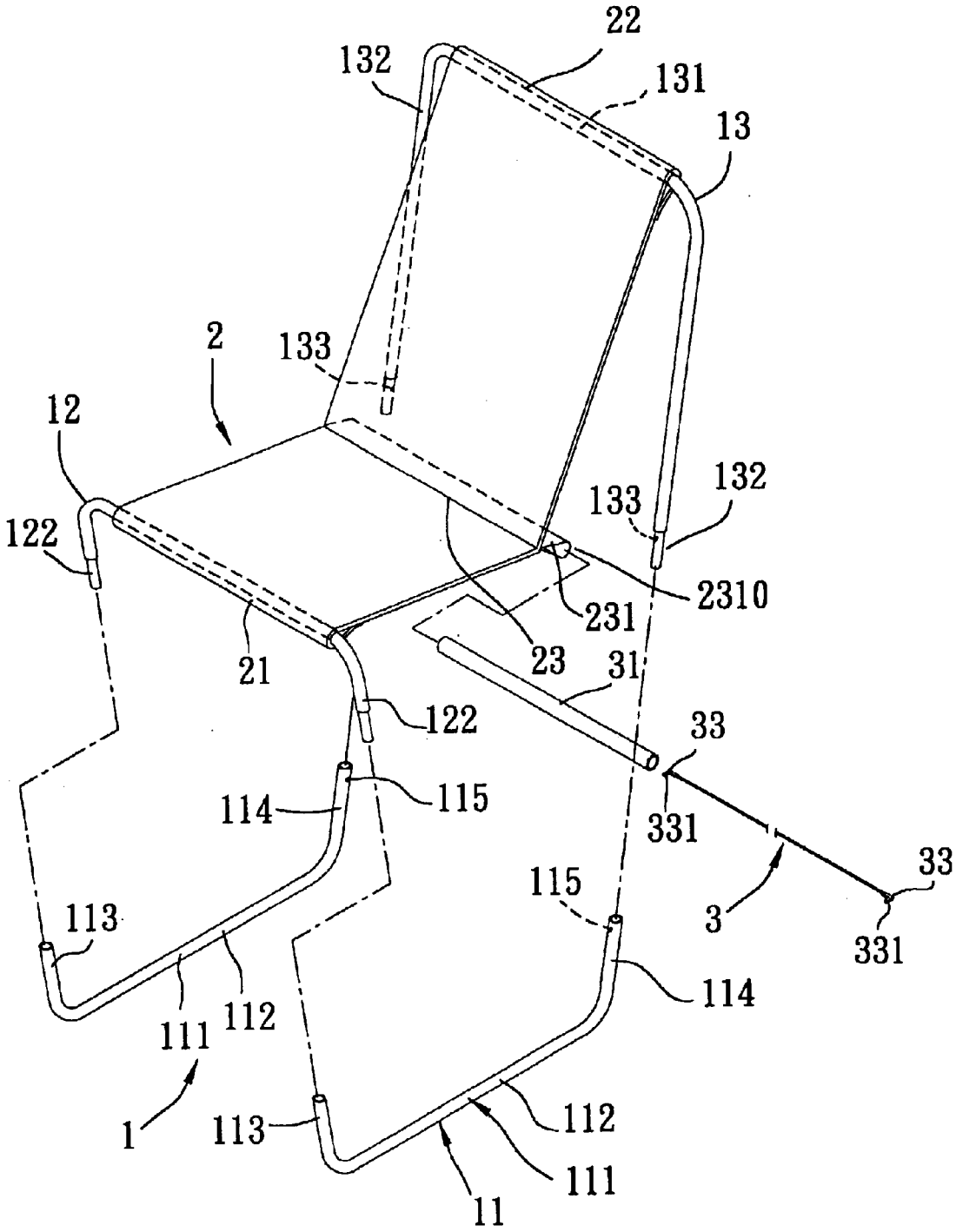
FIG. 1 is an exploded perspective view of the preferred embodiment of a chair according to the present invention.
Figure 2:
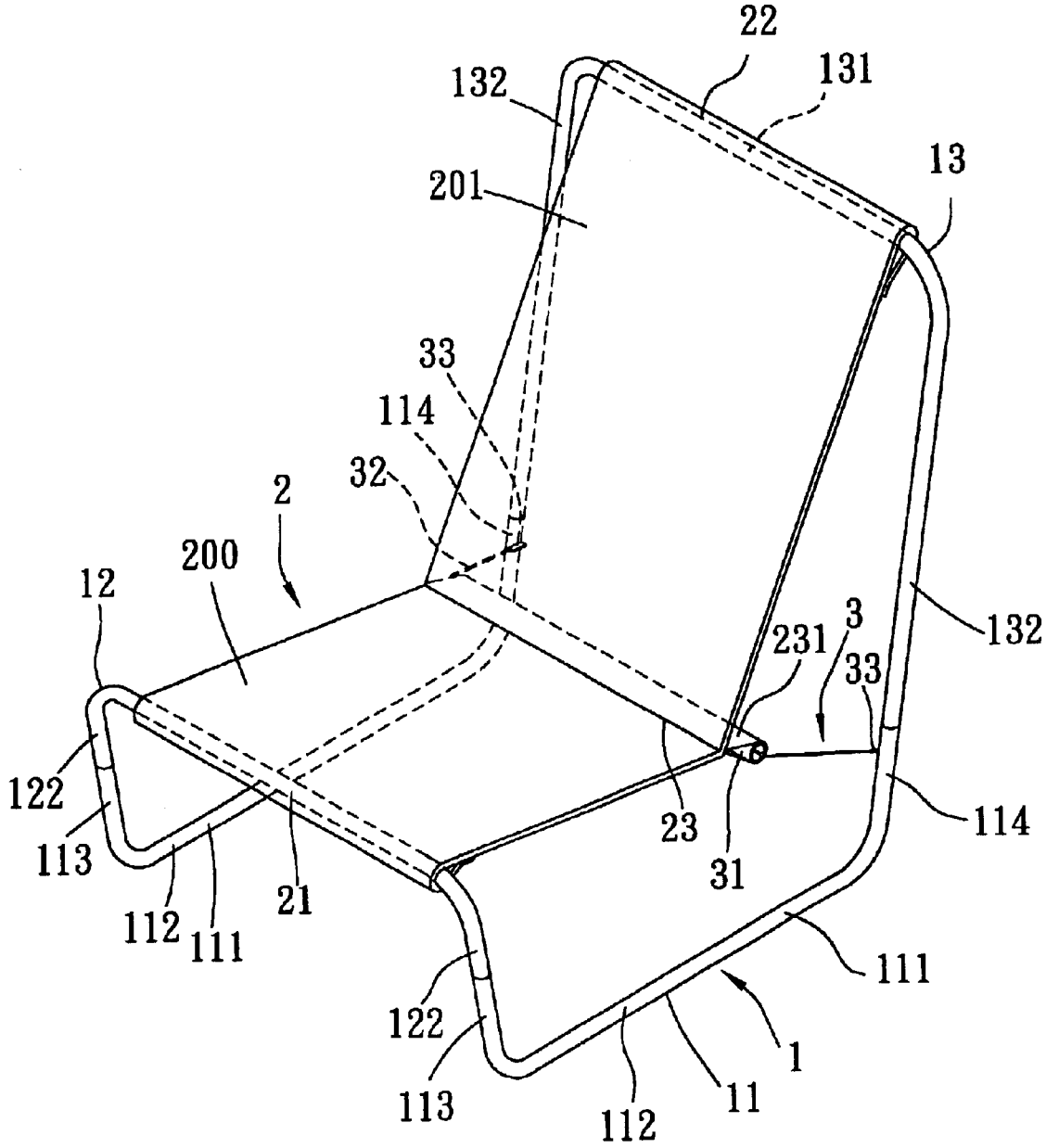
FIG. 2 is a perspective view of the preferred embodiment.
Figure 3:
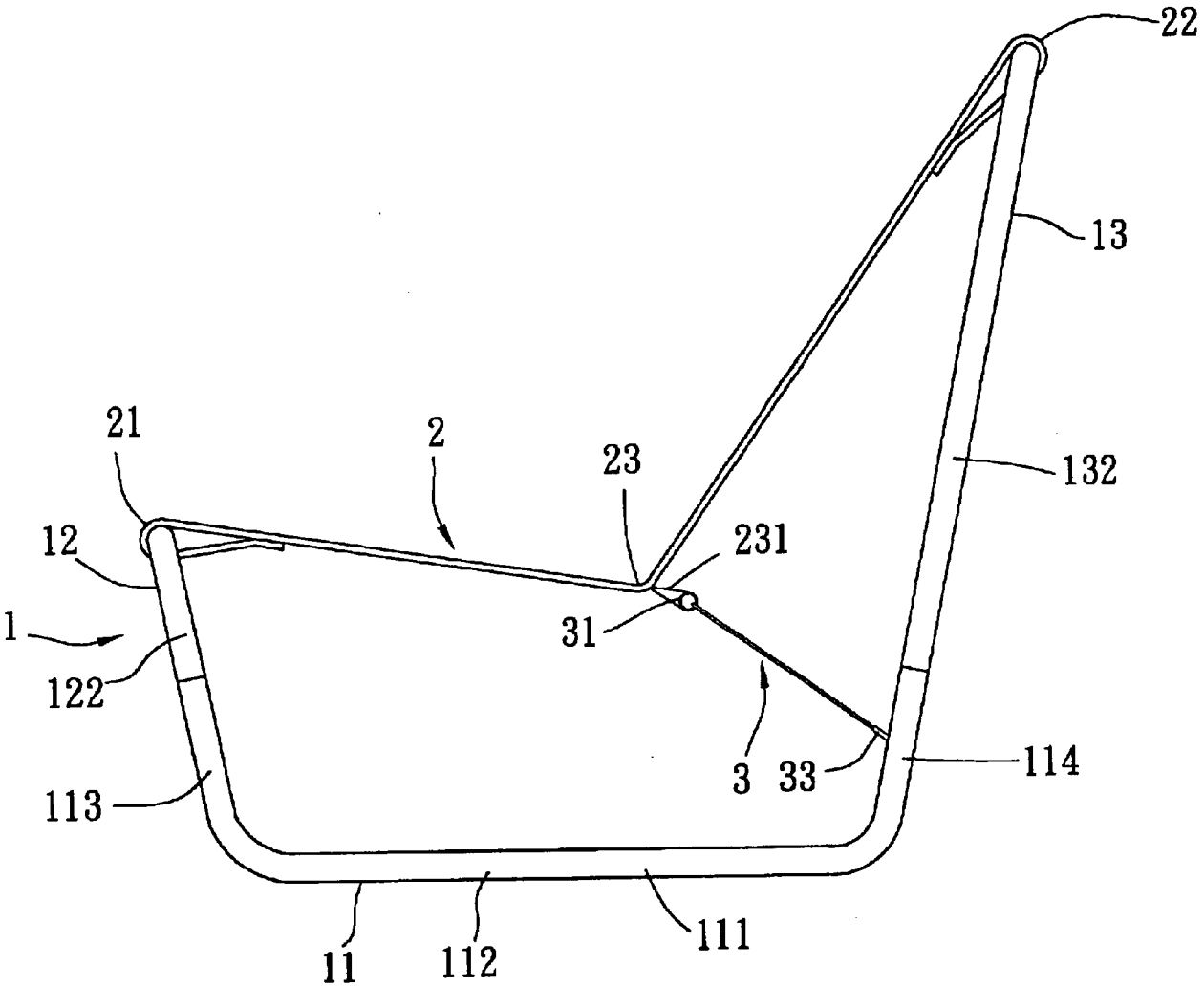
FIG. 3 is a side view of the preferred embodiment, illustrating how a flexible web is connected to a frame body.

Referring to FIGS. 1, 2 and 3, the preferred embodiment of a chair 2 according to the present invention is shown to include a detachable frame body 1, a seat in the form of a flexible web 2, and a string 3.

As illustrated, the frame body 1 includes a leg unit 11, a front seat rod member 12 disposed above and connected to the leg unit 11, and a backrest rod member 13 disposed above and connected to the leg unit 11. The backrest rod member 13 has a base rod portion 131 parallel to and disposed above the front seat rod member 12.

The flexible web 2 is formed with a front seat sleeve 21 sleeved on the front seat rod member 12, and a backrest sleeve. 22 sleeved on the base rod portion 131 of the backrest rod member 13. The web 2 is divided into a seat part 200 that extends rearwardly from the front seat sleeve 21, and a backrest part 201 that extends upwardly and that is angled away from the seat part 200 to connect with the backrest sleeve 22. The backrest part 201 cooperates with the seat part 200 to define a corner 23 therebetween.

The string 3 interconnects the corner 23 of the flexible web 2 and one of the leg unit 11 and the backrest rod member 13 so as to secure the corner 23 to said one of the leg unit 11 and the backrest rod member 13.

The web 2 is further formed with a rear seat sleeve 231 that projects rearwardly from the corner 23, that is opposite to the front seat sleeve 21, and that has two opposite sleeve ends 2310. The frame body 1 further includes a hollow rear seat rod member 31 that is inserted through the rear seat sleeve 231 and that has two opposite ends extending respectively and outwardly from the opposite sleeve ends 2310 of the rear seat sleeve 231. The string 3 extends into and through the hollow rear seat rod member 31, and has two fastening ends 33 projecting outwardly and respectively from the opposite ends of the hollow rear seat rod member 31 and connected to the leg unit 11.

The leg unit 11 of the frame body 1 preferably includes hollow left and right U-shaped legs 111. Each of the left and right U-shaped legs 111 has a ground-contact section 112 extending in a longitudinal direction, and front and rear mounting sections 113,114 extending upwardly and respectively from opposite ends of the ground-contact section 112. Each of the front seat rod member 21 and the backrest rod member 13 is inverted U-shaped, and has downwardly extending left and right inserting ends 122, 132. The left and right inserting ends 132 of the backrest rod member 13 extend transversely from the base rod portion 131, and are detachably and respectively inserted into the rear mounting sections 114 of the left and right U-shaped legs 111. The left and right inserting ends 122 of the front seat rod member 12 are detachably and respectively inserted into the front mounting sections 113 of the left and right U-shaped legs 111.

Each of the left and right inserting ends 132 of the backrest rod member 13 is formed with a first engaging hole 133. Each of the rear mounting sections 114 of the left and right U-shaped legs 111 is formed with a second engaging hole 115 that registers with the first engaging hole 133 in a respective one of the left and right inserting ends 132 of the backrest rod member 13. Two hooks 331 are respectively fixed to the fastening ends 33 of the string 3. Each of the hooks 331 extends into and engages releasably the first engaging hole 133 in a respective one of the left and right inserting ends 132 of the backrest rod member 13 and the second engaging hole 115 in the rear mounting section 114 of a respective one of the left and right U-shaped legs 111.

Since the flexible web 2 and the string 3 are relatively light and are easily detachable from the frame body 1, and since the leg unit 11, the front and rear seat rod members 12, 31, and the backrest rod member 13 can be easily assembled to form the frame body 1, the chair of the present invention is convenient to store and transport.

With this invention thus explained, it is apparent that numerous modifications and variations can be made without departing from the scope and spirit of this invention. It is therefore intended that this invention be limited only as indicated in the appended claims.

I claim:

1. A chair comprising:

a frame body including a leg unit, a front seat rod member disposed above and connected to said leg unit, and a backrest rod member disposed above and connected to said leg unit and having a base rod portion parallel to and disposed above said front seat rod member;

a flexible web formed with a front seat sleeve sleeved on said front seat rod member, and a backrest sleeve sleeved on said base rod portion of said backrest rod member, said web being divided into a seat part extending rearwardly from said front seat sleeve, and a backrest part extending upwardly and angled away from said seat part to connect with said backrest sleeve, said backrest part cooperating with said seat part to define a corner therebetween; and a string interconnecting said corner of said flexible web and a selective one of said leg unit and said backrest rod member so as to secure said corner to said one of said leg unit and said backrest rod member;

wherein said web is further formed with a rear seat sleeve that projects rearwardly from said corner, that is opposite to said front seat sleeve, and that has two opposite sleeve ends, said frame body further including a hollow rear seat rod member inserted through said rear seat sleeve and having two opposite ends extending respectively and outwardly from said opposite sleeve ends of said rear seat sleeve, said string extending into and through said hollow rear seat rod member and having two fastening ends projecting outwardly from said opposite ends of said hollow rear seat rod member and connected to said leg unit.

2. The chair as defined in claim 1, wherein said leg unit of said frame body includes hollow left and right U-shaped legs, each of which has a ground-contact section extending in a longitudinal direction, and front and rear mounting sections extending upwardly and respectively from opposite ends of said ground-contact section, each of said front seat rod member and said backrest rod member being inverted U-shaped and having downwardly extending left and right inserting ends, said left and right inserting ends of said backrest rod member extending transversely from said base rod portion and being inserted into said rear mounting sections of said left and right U-shaped legs, said left and right inserting ends of said front seat rod member being inserted into said front mounting sections of said left and right U-shaped legs.

3. The chair as defined in claim 1, wherein each of said left and right inserting ends of said backrest rod member is formed with a first engaging hole, each of said rear mounting sections of said left and right U-shaped legs being formed with a second engaging hole that registers with said first engaging hole in a respective one of said left and right inserting ends of said backrest rod member, said chair further including a pair of hooks respectively fixed to said fastening ends of said string, each of said hooks extending into and engaging said first engaging hole in a respective one of said left and right inserting ends of said backrest rod member and said second engaging hole in said rear mounting section of a respective one of said left and right U-shaped legs.

* * * * *